US005977524A

United States Patent [19]

Deo et al.

[11] Patent Number: 5,977,524

[45] Date of Patent: Nov. 2, 1999

[54] MICROWIRE STAPLE FOR HOLDING THE RESISTIVE MEMBER OF A HEATING ELEMENT IN PLACE

[75] Inventors: Subhash R. Deo, Fayette, Ala.; Simon P. Griffiths, Columbus, Miss.

[73] Assignee: Emerson Electric Company, St. Louis, Mo.

[21] Appl. No.: 08/950,670

[22] Filed: Oct. 15, 1997

[51] Int. Cl.[6] ..... H05B 3/68

[52] U.S. Cl. ..... 219/461.1

[58] Field of Search ..... 219/458, 463, 219/464, 465, 466, 467, 468, 542, 546; 338/280, 281, 284

[56] References Cited

U.S. PATENT DOCUMENTS

| | | | |
|---|---|---|---|
| 3,612,828 | 10/1971 | Siegla | 219/467 |
| 3,833,793 | 9/1974 | McWilliams et al. | 219/467 |
| 4,161,648 | 7/1979 | Gössler . | |
| 4,296,311 | 10/1981 | Hagglund et al. | 219/467 |
| 5,181,312 | 1/1993 | Gross | 29/611 |
| 5,369,874 | 12/1994 | McWilliams . | |
| 5,393,958 | 2/1995 | Gross et al. . | |
| 5,453,597 | 9/1995 | McWilliams . | |
| 5,837,975 | 11/1998 | Dillard et al. | 219/467 |

*Primary Examiner*—Sang Paik

*Attorney, Agent, or Firm*—Polster, Lieder, Woodruff & Lucchesi

[57] ABSTRACT

A heating unit (H) for a cook top includes a ribbon-type heating element (E). The heating element is mounted on the upper surface of a cake (I) of microporous insulation material. The heating element is arranged in a predetermined pattern on the material and a plurality of staples (10) are used to attach and hold the heating element on the material surface. Each staple is a microwire staple and the staples are spaced along the length of the heating element to mount the heating element to the insulation. The microwire staples have a small thermal mass and so do not create heat sinks at their locations of use. Thus, they do not affect the efficiency of heat transfer between the heating element and that which is being heated. The staples are also preferably of the same metal alloy as that from which the heating element is formed so the staples can withstand high temperatures and numerous temperature cycles to provide a long service life.

14 Claims, 1 Drawing Sheet

MICROWIRE STAPLE FOR HOLDING THE RESISTIVE MEMBER OF A HEATING ELEMENT IN PLACE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to heating units employing resistive conductors to construct heat elements, and more particularly, to a microwire staple used to attach and hold such an element in place on a thermal and electrical insulation material.

In electrical heating units of the type used in cook tops for ranges, one type of heating element employed is a resistive conductor exposed to air. When an electric current is passed through the conductor, the power dissipated raises the conductor's temperature. Radiant energy is generated which performs the heating function of the element. In some applications, a thin, elongate strip of a metallic ribbon heating material is passed through a machine which corrugates the material. Such a construction is shown, for example, in U.S. Pat. No. 5,393,958. Other patents of interest with respect to ribbon heating elements include U.S. Pat. 5,453,597, 5,369,874 and 4,161,648. When a current is applied to the ribbon heating element, heat generated by the resulting $I^2r$ losses is radiated at a utensil set upon the unit. During a heating cycle, the heating element expands and contracts. If the element is constrained to move, stresses are created in the material; and, stress fractures are the primary cause of heating element failures.

It is also known that instead of pressing an edge of a ribbon heating element into the insulation material to lay the heating element on top of the insulation material but to not press it into the material. Rather, metal staples are used to secure the heating element in place. There are, however, a number of problems with this approach as well. First, the staples create non-uniform heating spots because of the concentrated mass of material at each staple location. In addition, the staples obstruct heat radiation to the utensil being heated because the staples absorb the heat radiated by the ribbon heating element in the area around the staple. The conventional wire staples are also quite rigid and they damage the heating element member when pressed too tightly against the heater conductor. The large cross section of the conventional staple does not allow them to be placed close together; this is necessary to avoid short circuits as well as insertion damage to the insulating cake. This leaves large segments of the heater conductor unconstrained and may lead to the unwanted movement of that conductor during handling and transportation. The bulk of the conventional wire staple has excess thermal mass that drains the heat energy from the conductor to raise its temperature. This affects the overall performance of the unit. The conventional wire staple is never able to absorb enough heat from the conductor to become radiant. This together with its large size has a masking effect on the glowing conductor of the heating unit, resulting into dark areas at different locations over the heater geometry. This is aesthetically undesirable.

BRIEF SUMMARY OF THE INVENTION

Among the several objects of the present invention may be noted the provision of staples for use with a ribbon heating element used for a cooking unit or the like for installing the heating element; the provision of such a staple to be a microwire staple having a diameter which is less than 0.01" and a thermal mass which is approximately 5% of the thermal mass of conventional staples;

the provision of such a staple which effectively mounts the heating element in place without damaging a cake of insulation material on which the element is installed and which allows the heating element to expand and contract during a heating cycle;

the provision of such a staple to not effect the efficiency of heat transfer between the heating element and whatever is being heated by eliminating hot spots at those locations where a staple is used;

the provision of such a staple to have legs of different lengths such that when the staple is inserted in place, the short leg is required to be above the insulating cake, thereby providing an automatic visual check that the long leg has not touched the metallic pan supporting the insulating cake;

the provision of such a staple which, when used, does not appear as a dark spot to one viewing the heating element so the heating element, when a current is supplied to it, has a uniform appearance;

the provision of such a staple to be of a material corresponding to the material of which the heating element is formed;

the provision of such a staple to be made of a Fe—Cr—Al alloy material;

the provision of such a microwire staple to have sufficient mechanical strength to withstand numerous heating cycles of the heating element without failing;

the provision of such a microwire staple which is readily installed by an automated manufacturing process so to simplify the cost of assembly of a heating unit; and, the provision of such a microwire staple which is low cost.

In accordance with the invention, generally stated, a heating unit for a cook top or the like includes a ribbon-type heating element. The heating element is mounted on the upper surface of a cake of microporous insulation material. The heating element is arranged in a predetermined pattern on the material and a plurality of staples are used to attach and hold the heating element on the material surface. Each staple is a microwire staple and the staples are spaced along the length of the heating element. The staples have a thermal mass which is less than 5% that of conventional staples and so do not create heat sinks at their locations of use. Thus, their use does not affect the efficiency of heat transfer between the heating element and that which is being heated. Preferably, the staples are of the same material as the heating element and the staples have legs one of which is shorter than the other. The short leg provides a visual indication that the staple is not shorted to a pan holding the insulation material and heating element. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

Detailed Description of the Invention

Figure 1:
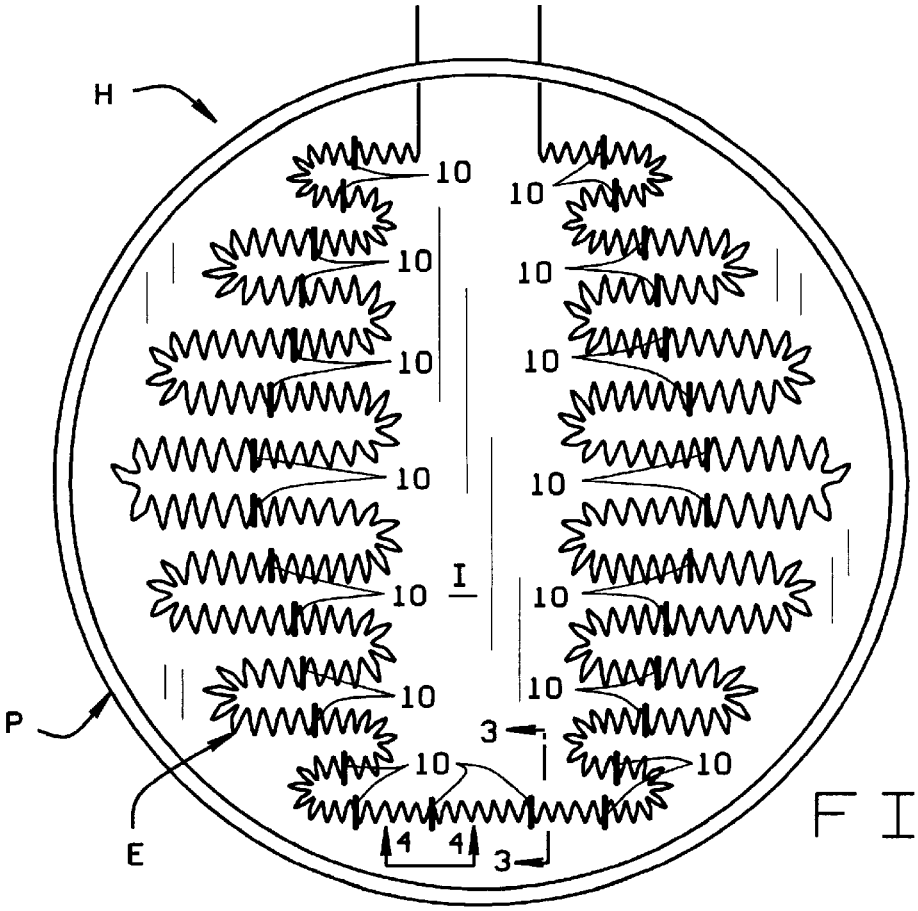
FIG. 1 is a top plan view of a cooking unit including a cake of insulation material and a ribbon heating element which is installed on the insulation material.
Figure 5:
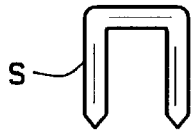
FIG. 5 PRIOR ART
FIG. 5 is an elevational view of a prior art staple used to mount the heating element to the insulation.
Figure 4:
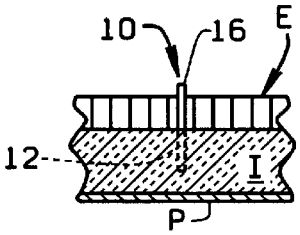
FIG. 4 is a sectional view taken along line 4—4 in FIG. 1 also showing use of the staple.

Referring to the drawings, a heating unit H is used on cook tops for stoves and ranges. The heating unit includes a circular metal pan P which is a generally flat bottomed pan having an upraised side extending about the circumference of the pan. A cake I of a microporous insulation material is sized to fit in the pan. A heating element E having a preferred pattern or shape is installed or mounted on an upper surface of the insulation material. The pattern shown in FIG. 1 is exemplary only. As seen in FIGS. 1 and 4, the heating element is a ribbon heating element; that is, it has a series of corrugations formed along its length. Heretofore, a ribbon heating element was mounted on the insulation by either pressing an edge of the element into the insulation, forming grooves in the insulation and inserting the edge of the heating element into the grooves, or laying the heating element on the surface of the insulation and pressing wire metal staples S such as shown in FIG. 5 into the insulation material to hold the heating element in place. The problems with the use of such staples have been previously described. In general, their use creates a range of problems in the manufacture and use of a heating unit employing a ribbon heater element.

Figure 2:
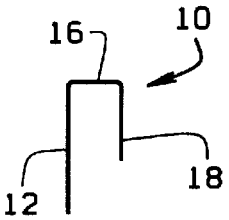
FIG. 2 is side elevational view of a microwire staple of the present invention used to mount the heating element on the insulation.

In accordance with the present invention, and as shown in FIG. 2, a staple 10 is used in place of the staples S to securely mount a heating element E to the upper surface of a cake I of insulation material. The staples 10 are microwire staples made of a metallic alloy material having a diameter of less than 0.01" (0.025 cm.), and preferably 0.008" (0.02 cm.). Further, a preferred embodiment of the microwire staples 10 is that they are made of a material that is capable of withstanding high temperatures and the repeated temperature cycles to which the heating element is subjected. The staples 10 have a number of advantages over conventional staples S. A major advantage is that the microwire staples 10, besides having good heat transfer characteristics, also represent a small thermal mass. A staple 10 of generally the same height and width dimensions as a conventional staple S has only approximately 5% of the thermal mass of such staples. As such, their use does not affect the efficiency of heat transfer between heating element E and that which is being heated by the heating unit. The staples do not form heat sinks at those locations where they are used so hot spots are eliminated. In addition, use of the microwire staples provides an improved cosmetic appearance particularly when the heating element is at temperature because dark spots normally created by conventional staples are eliminated. In addition, the very small wire diameter greatly facilitates the insertion of the staple into the insulating cake.

Figure 3:
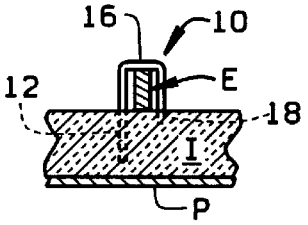
FIG. 3 is a sectional view taken along line 3—3 in FIG. 1 showing use of the staple.

Microwire staples 10 are generally U-shape in form with one leg 12 of the staple being longer than the other leg 14 thereof. This is important because of the potential for electrical shorts caused by a staple bottoming out against pan P. The staple is inserted with the end of the short leg not penetrating into the cake. This then provides a visual check that the long leg is a known minimum distance from the bottom of the pan and that the staple will not short out against the pan. The base or top 16 of the staple is sufficiently wide so the staple easily spans the width of the heating element as shown in FIG. 3. This is important because during a heating cycle, the heating element expands. While the heating element must be constrained so that a desired heating pattern is maintained, the constraint cannot be so tight that stress is created in the element because it cannot sufficiently flex.

Finally, it is a feature of microwire staples 10 that the staples can be used in an automated manufacturing process so the staples can be automatically inserted in place during assembly of the heating unit.

What has been described is a microwire staple used with a ribbon heating element to mount the heating element in place without damaging a cake of insulation material on which the element is installed, and which allows the heating element to expand and contract during a heating cycle. The microwire staple increases the efficiency of the heating element by eliminating hot spots at those locations where the staples are used because the microwire staples represent only a small thermal mass. Further, the staples do not appear as dark spots to one viewing the heating element so the heating element has a uniform appearance. The staple is made of a metal alloy which is preferably the same as that used to make the heating element. The staples have sufficient mechanical strength to withstand numerous heating cycles of the heating element without cracking or breaking, even though their diameter is less than 0.01". Further, the staples, which can be readily installed by an automated manufacturing process provide a low cost, effective solution to conventional wire staples.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

We claim:

1. In a heating unit comprising a heating element for generating heat when an electrical current is supplied thereto, and an insulation material having a surface upon which said heating element is placed, said heating element being arranged in a predetermined pattern upon said surface, the improvement comprising a staple securing said heating element upon said surface, said staple being formed of a microwire having a diameter of less than 0.01" so to have a thermal mass which reduces the heat sink created at the location where the staple is used so to effect a more efficient heat transfer between the heating element and that which is being heated by the heating element.

2. The improvement of claim 1 wherein said microwire staple is of the same material as said heating element.

3. The improvement of claim 2 wherein said staple is formed of a Fe—Cr—Al alloy.

4. The improvement of claim 2 including a plurality of microwire staples spaced along the length of said heating element to attach said heating element to said insulation material.

5. The improvement of claim 2 wherein said microwire has a diameter of 0.008".

6. The improvement of claim 2 wherein said staple is generally U-shaped with one leg of the staple being longer than the other.

7. A heating unit comprising:

a ribbon-type heating element for generating heat when an electrical current is supplied thereto;

an insulation material having a surface upon which said heating element is placed, said heating element being arranged in a predetermined pattern upon said surface; and, a staple securing said heating element upon said surface, said staple being formed of a microwire having a diameter of less than 0.01" which reduces the heat sink created at the location where the staple is used so to effect a more efficient heat transfer between the heating element and that which is being heated by the heating element.

8. The heating unit of claim 7 wherein said microwire staple is of the same material as said heating element.

9. The heating unit of claim 8 wherein said staple is formed of a Fe—Cr—Al alloy.

10. The heating unit of claim 7 including a plurality of microwire staples spaced along the length of said heating element to attach said heating element to said insulation material.

11. The heating unit of claim 7 wherein said microwire has a diameter of 0.008".

12. The heating unit of claim 7 wherein said staple is generally U-shaped with one leg of the staple being longer than the other.

13. In a heating unit comprising a heating element for generating heat when an electrical current is supplied thereto, and an insulation material having a surface upon which said heating element is placed, said heating element being arranged in a predetermined pattern upon said surface, the improvement comprising a staple securing said heating element upon said surface, said staple being formed of a microwire having a thermal mass which reduces the heat sink created at the location where the staple is used so to effect a more efficient heat transfer between the heating element and that which is being heated by the heating element, the microwire staple being of the same material as said heating element and said staple being generally U-shaped with one leg of the staple being longer than the other.

14. A heating unit comprising:

a ribbon-type heating element for generating heat when an electrical current is supplied thereto;

an insulation material having a surface upon which said heating element is placed, said heating element being arranged in a predetermined pattern upon said surface; and, a staple securing said heating element upon said surface, said staple being formed of a microwire which reduces the heat sink created at the location where the staple is used so to effect a more efficient heat transfer between the heating element and that which is being heated by the heating element, said staple being generally U-shaped with one leg longer than the other.

* * * * *